United States Patent [19]

Benaroya

[11] Patent Number: 4,481,772

[45] Date of Patent: Nov. 13, 1984

[54] GAS TURBINE POWER PRODUCTION UNIT INCLUDING A FREE PISTON GAS GENERATOR

[76] Inventor: Henry Benaroya, 41, Blvd. du Commandant Charcot 92200, Neuilly sur Seine, France

[21] Appl. No.: 536,372

[22] Filed: Sep. 27, 1983

[30] Foreign Application Priority Data

Sep. 27, 1982 [FR] France ..... 82 16225

[51] Int. Cl.[3] ..... F02B 71/04

[52] U.S. Cl. ..... 60/595

[58] Field of Search ..... 60/595

[56] References Cited

U.S. PATENT DOCUMENTS 3,005,306 10/1961 Bush ..... 60/595

3,103,100 9/1963 Hryniszak ..... 60/595

3,136,118 6/1964 Horgen ..... 60/595

*Primary Examiner*—Allen M. Ostrager

*Attorney, Agent, or Firm*—Larson and Taylor

[57] ABSTRACT

A power plant comprises a free piston gas generator having compression chambers and motor cylinders. A reciprocable assembly has drive pistons which are slidably received in the motor cylinders and compression pistons, each slidable for defining a variable volume compression chamber. A rotary compressor delivers air at above atmospheric pressure to the compressor chambers which are distributed into a first set and a second set. The outlets of the first set deliver air to the motor cylinders. The second set delivers pressurized air to the exhaust gas and the mixture is admitted into a power gas turbine. The temperature of the mixture of hot air and exhaust gas is increased before delivery to the turbine by a heat exchanger and a compression chamber.

10 Claims, 2 Drawing Figures

GAS TURBINE POWER PRODUCTION UNIT INCLUDING A FREE PISTON GAS GENERATOR

BACKGROUND AND SUMMARY OF THE INVENTION

The invention relates to power production units of the type comprising a free piston gas generator having a plurality of compression chambers and at least one motor cylinder as well as a gas turbine which receives the exhaust gas from the combustion chambers of the motor cylinder(s) and/or pressurized gas from the compression chambers and which may drive an electric generator.

A power unit of that type is described in Applicant's earlier European Patent No. 0007 874. The compression chambers of that power unit are distributed into two sets. The compression chambers of the first set deliver hot pressurized air to an auxiliary turbine which drives a rotary compressor for supercharging all compression chambers through cooling means. The motor cylinder(s) receive(s) pressurized air from the other set of compression chambers and their combustion gases are directed to a power gas turbine which also receives part of the hot air from the first set.

The arrangement has the advantage that use is made of the hot air flow delivered by the compression chambers and in excess of that necessary for efficient operation of the motor cylinders, (whose working cycle is somewhat comparable to that of a two stroke Diesel engine) under acceptable conditions. However, that air which is delivered by the first set is at a temperature substantially lower than the exhaust gas. For avoiding thermal problems at the output of the compression chambers, it is of advantage to increase the rate of flow—and consequently to decrease the output temperature—rather than the pressure. Mixing of gas and hot air at different temperatures is far from an optimum.

It is an object of the invention to provide a power unit of the above type which has an increased efficiency without requiring high gas temperatures which detrimentally affect the components subjected to the action of hot gas. It is a more specific object to provide a power unit which associates the high air compression efficiency of alternating machines and the high degree of efficiency and long life of gas turbines.

For that purpose, there is provided a power unit comprising a free piston gas generator having a plurality of compression chambers, motor cylinder means, and a reciprocable assembly having drive piston means slidably received in said motor cylinder means and a plurality of compression pistons cooperating with said compression chambers, whereby reciprocation of said assembly alternately increases and decreases the volumes of said compression chambers and a power gas turbine connected to receive a flow of exhaust gas from an exhaust of said motor cylinder means. The unit further comprises a rotary compressor connected to the compression chambers through first cooling means to deliver air at above atmospheric pressure to the compressor chambers, which are distributed into a first set and a second set. The outlets of the first set of compression chambers are connected to deliver air to the motor cylinder means through second cooling means, the outlets of the second set are connected to deliver hot pressurized air to the flow of exhaust gas prior to admission to said power gas turbine and the gas mixture is delivered to the turbine where it expands. Heating means are provided for increasing the temperature of the mixture of hot air and exhaust gas before delivery to the turbine. They include heat exchange means for heat exchange between said hot pressurized air and gas which has expanded in the gas turbine and/or a combustion chamber. The rotary compressor may preferably be driven by an auxiliary gas turbine connected to receive gas from the outlet of the power turbine and to deliver that gas to the heat exchanger means. The combustion chamber is typically dimensioned for the thermal power developed by said chamber to be of the same order of magnitude as that of the motor cylinders.

In a particular embodiment, the unit may comprise an additional high pressure loop having a rotary HP compressor connected to receive air from the second set of compression chambers and a rotary HP turbine for driving the HP compressor. The gas expanded in the HP turbine mixes with the flow of exhaust gas. A second combustion chamber is then located in the loop between the HP compressor and the HP turbine. Then, the thermal energy added by the heating means will result into a pressure increase and after expansion in the HP gas turbine. For decreasing that pressure to a level equal to that of the exhaust gas from the motor cylinders, the unit may include a gas pressure balancing turbine connected to receive the gas from the HP turbine and to reduce its pressure to a value substantially equal to that of the exhaust gas prior to mixing.

The invention will be better understood from the following description of preferred embodiments of the invention, given by way of examples only.

SHORT DESCRIPTION OF THE DRAWINGS

DETAILED DESCRIPTION OF PREFERRED EMBODIMENTS

Figure 1:
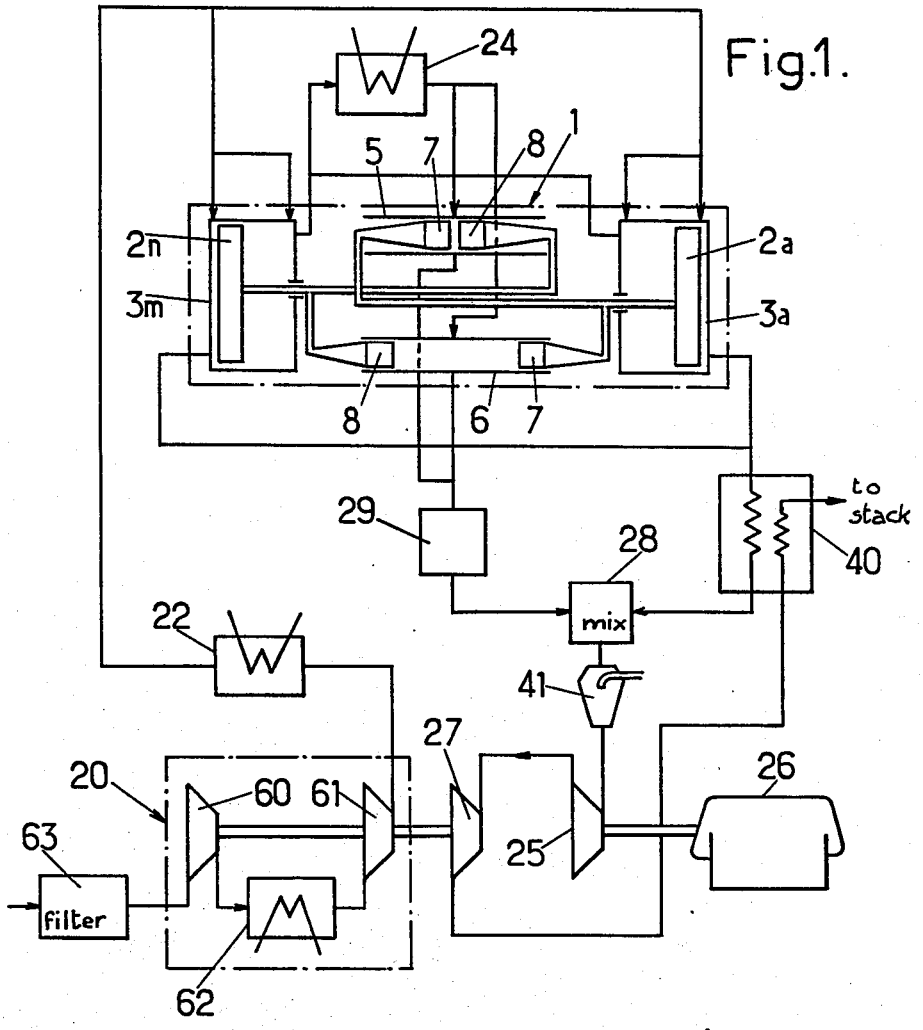
FIG. 1 is a diagram illustrating a power production unit according to a first embodiment of the invention.

Referring to FIG. 1, there is illustrated a unit of the same general type as that described in European Pat. No. 0 007 874, the content of which is included in the present disclosure by way of reference. The unit comprises a free piston multi-tandem gas generator 1 which may be of the type described in U.S. Pat. No. 3,669,571, or U.S. patent application Ser. No. 229,561 of the present Applicant. The illustrated free piston gas generator hs two compressor cylinders 3*a*, 3*n* slidably receiving compressor pistons 2*a*, 2*n* which define compression chambers. Piston 2*n* is operatively connected by a rigid linkage to two motor pistons 7 respectively located in stationary motor cylinders 5 and 6. Piston 2*a* is operatively connected by a rigid linkage to pistons 8 also slidable in cylinders 5 and 6. In an actual unit, a greater number of cylinders would however be provided, as described in the above references.

The compressor cylinders 3*a*, 3*n* receive air at above atmospheric pressure from a rotary supercharging compressor 20 through an air cooler 22. The air additionally pressurized in the inner compressor chambers of compressor cylinders 3*a* and 3*n* flows through a second air cooler 24 before being admitted into the motor cylinders 5 and 6 through intake and scavenging apertures. The exhaust gas from the motor cylinders are directed to one or more gas turbines 25 driving a load, such as an A.C. generator 26, as will be described in greater detail in the following.

Air additionally pressurized in the outer chambers of the compressor cylinders 3*a*, 3*n* is directed to gas mixer 28 consisting of an enclosure which receives the exhaust gas from the motor cylinders through control valve 29 and pressurized air. The air-gas mixture is directed to the gas turbine 25 through a combustion chamber 41. The fuel introduced into the combustion chamber is burnt in the large air excess present in the mixture, whereby a large temperature increase is obtained. As a result, the gas temperature at the intake of gas turbine 25 is high enough for providing efficient operation.

In the illustrated embodiment, the exhaust gas, still at a relatively high temperature, from gas turbine 25, is directed to an auxiliary gas turbine 25 whose rotor is secured to the shaft of supercharging compressor 20. The gas flowing out of the auxiliary turbine 25 is used for reheating of the air delivered by the outer chambers of the compressor cylinders before it is admitted to the gas mixer 28. For that purpose, a heat exchanger 40 is provided for counter-current circulation of the air flow from the outer chambers of the compressor cylinders and gas flowing from turbine 27 to atmosphere.

The supercharging compressor 20 has preferably two compressor units 60 and 61, with an intermediate cooler 62. An air filter 63 is typically provided on the intake of unit 60.

Figure 2:
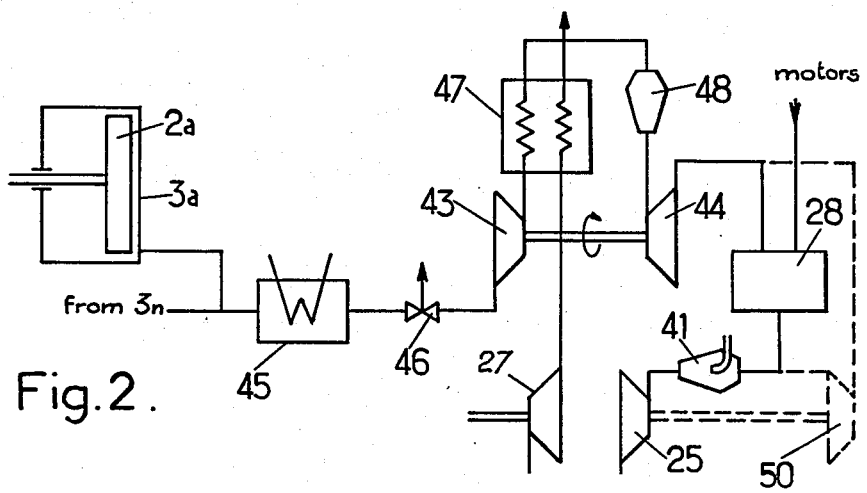
FIG. 2 is a diagram illustrating a second embodiment.

A higher power may be attained while retaining a satisfactory efficiency with the embodiment of FIG. 2, which includes an additional high pressure cycle. Referring to FIG. 2, there is illustrated that part of the arrangement which differs from that of FIG. 1. The high pressure loop includes a high pressure turbine-compressor unit having a compressor 43 and a turbine 44 on the same shaft, which is distinct from the shaft of the A.C. generator 26 and consequently can rotate at a variable speed. Compressor 43 receives air from the outer chambers of compressor cylinders 3*a* and 3*n*, preferably through an air cooler 45 and a waste gate 46 which makes it possible to discharge the air flow from the compressor through the atmosphere, if need arises. The high pressure loop comprises a heat recuperator 47 and a second combustion chamber 48 between compressor 43 and turbine 44. The mixture of air and combustion gases from chamber 48 partially expands in the high pressure turbine 44. Typically, no useful load will be driven by the shaft of the high pressure turbine compressor unit and, consequently, the pressure at the outlet of turbine 44 will be higher than the intake pressure of compressor 43 and it may be used in a number of ways.

On the condition that the power plant is provided with a regulation system which maintains the outlet pressure of turbine 44 at a value which is comparable to that of the motor cylinders, the two gas flows may be mixed in a mixer 28, as illustrated in FIg. 2. That decreases the compression work required from the compressors for a predetermined value of the flow. Since the power available for the generator is determined by operation of the motor cylinders 2*a* and 2*n*, the secondary air flow delivered to the high pressure loop by the compressor may be varied in the range which is allowed by the technological limits as to the possible diameter of the compressor cylinders.

The gas mixture from the high pressure loop has a high percentage of air. It is delivered to the combustion chamber 41 whose outlet is connected to the intake of the power gas turbine 25 which drives the A.C. generator (not shown in FIG. 2). In that embodiment, the air flow from the outer chambers of the compressors expands in the power gas turbine 25 before it is delivered to the auxiliary turbine 27 which drives the rotary compressor 20. The latent heat which is still present in the gas after it has expanded in turbine 27 is again used for reheating air in the high pressure cycle in recuperator 47.

In an other embodiment, the regulation system is designed for the gas pressure at the outlet of turbine 44 to be higher than the outlet pressure of the motor cylinders 5 and 6. Then the gas flow from turbine 44 should be expanded in a supplementary balancing turbine which decreases the pressure to the same value as at the outlet of the motor cylinders. As illustrated in doted lines in FIG. 2, that additional turbine 50 may be carried by the common shaft of the A.C. generator 26 and power gas turbine 25.

By way of example, the following data may be considered as representative of a power plant of the type illustrated in FIG. 1 in the 50 MW range with an efficiency of about 0.43.

A.C. Generator
51.2 MW at rated power
Supercharging compressor delivering 143 kg/s under 3.52 bars, separated into:
primary flow of 62 kg/s to inner chambers
secondary flow of 81 kg/s to air-gas exchanger
Motor cylinders having a fuel consumption of 1.217 kg/s and delivering gas at 10 bars, 790 K (degrees Kelvin)
Combustion chamber having a fuel consumption of 1.63 kg/s
Power turbine
Intake: pressure 9.52 bars; temperature: 1088K
Outlet: pressure 2.7 bars; temperature: 810K
Compressor driving turbine
Outlet: pressure 1.04 bar; temperature: 622K.

I claim:

1. A power unit comprising:

a free piston gas generator having a plurality of compressor chambers, motor cylinder means, and a reciprocable assembly having drive piston means slidably received in said motor cylinder means and a plurality of compression pistons cooperating with said compression chambers, whereby reciprocation of said assembly alternately increases and decreases the volumes of said compression chambers, a power gas turbine connected to receive a flow of exhaust gas from an exhaust of said motor cylinder means, a rotary compressor connected to said compression chambers through first cooling means to deliver air at chambers through first cooling means to deliver air at above atmospheric pressure to said compressor chambers, said compressor chambers being distributed into a first set and a second set with outlets of the first set of said compression chambers being connected to deliver air to said motor cylinder means through second cooling means and outlets of the second set being connected to deliver hot pressurized air to said flow of exhaust gas prior to admission to said power gas turbine, whereby said exhaust gas and hot air mix before delivery to the turbine, and heating means for increasing the temperature of the mixture of hot air and exhaust gas before delivery to the turbine.

2. A unit according to claim 1, wherein said heating means include heat exchange means for heat exchange between said hot pressurized air and gas from said power gas turbine.

3. A unit according to claim 2, further including an auxiliary gas turbine connected to receive gas from the outlet of the power turbine and to deliver that gas to said heat exchanger means after it has cooled down through said auxiliary turbine.

4. A unit according to claim 1, wherein said heating means include a combustion chamber.

5. A unit according to claim 4, wherein said combustion chamber is dimensioned for the thermal power developed by said chamber to be on the same order of magnitude as that of said motor cylinders.

6. A unit according to claim 1, further comprising a high pressure loop having a rotary high pressure compressor connected to receive air from said second set of compression chambers and a rotary high pressure turbine drivably connected to said high pressure compressor and having its outlet connected to deliver combustion gas to said flow of exhaust gas, wherein said heating means comprises a combustion chamber located in the loop between said high pressure compressor and said high pressure turbine.

7. A unit according to claim 6, wherein said heating means further include heat exchange means for heat exchange between the air flow from sid high pressure compressor and gas expanded in said power turbine after it has been further cooled down in an auxiliary turbine.

8. A unit according to claim 7, further comprising a pressure balancing turbine connected to receive the outlet gas from the high pressure turbine, dimensioned and controlled for reducing the pressure of the combustion gas from said high pressure turbine to a value substantially equal to that of the exhaust gas of the motor cylinders prior to mixing said combustion gas and exhaust gas.

9. A unit according to claim 8, wherein said power turbine and said pressure balancing turbine are carried by a same shaft driving an electric generator constituting a useful load of the unit.

10. A unit according to claim 1, further including an auxiliary gas turbine drivably connected to said rotary compressor and connected to receive gas from the outlet of the power turbine and to deliver that gas to said heat exchanger means after it has cooled down through said auxiliary turbine, said heating means further including a combustion chamber.

* * * * *